US009808903B2

(12) United States Patent
Ishii et al.

(10) Patent No.: US 9,808,903 B2
(45) Date of Patent: Nov. 7, 2017

(54) METHOD OF POLISHING BACK SURFACE OF SUBSTRATE AND SUBSTRATE PROCESSING APPARATUS

(71) Applicant: EBARA CORPORATION, Tokyo (JP)

(72) Inventors: Yu Ishii, Tokyo (JP); Kenya Ito, Tokyo (JP); Masayuki Nakanishi, Tokyo (JP); Tetsuji Togawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 395 days.

(21) Appl. No.: 14/167,934

(22) Filed: Jan. 29, 2014

(65) Prior Publication Data

US 2014/0220866 A1 Aug. 7, 2014

(30) Foreign Application Priority Data

Feb. 1, 2013 (JP) ..... 2013-018476

(51) Int. Cl.

| | |
|---|---|
| ***B24B 21/06*** | (2006.01) |
| ***B24B 37/04*** | (2012.01) |
| ***B24B 37/30*** | (2012.01) |
| ***B24B 7/22*** | (2006.01) |
| ***B24B 21/00*** | (2006.01) |

(52) U.S. Cl.

CPC ..... *B24B 7/228* (2013.01); *B24B 21/004* (2013.01); *B24B 21/06* (2013.01); *B24B 37/04* (2013.01); *B24B 37/042* (2013.01); *B24B 37/30* (2013.01)

(58) Field of Classification Search

CPC ..... B24B 7/228; B24B 21/004; B24B 21/02; B24B 21/06; B24B 37/04; B24B 37/042; B24B 37/30

USPC ..... 451/41, 44, 287, 289, 307

See application file for complete search history.

(56) References Cited

U.S. PATENT DOCUMENTS

| | | | | |
|---|---|---|---|---|
| 6,245,677 | B1 | 6/2001 | Haq | |
| 6,878,630 | B2 * | 4/2005 | Bang | H01L 21/02008 257/E21.214 |
| 6,913,520 | B1 * | 7/2005 | Liao | B24B 37/042 451/41 |

(Continued)

FOREIGN PATENT DOCUMENTS

| | | | |
|---|---|---|---|
| EP | 2762274 | A2 | 8/2014 |
| JP | 08-071511 | A | 3/1996 |

(Continued)

OTHER PUBLICATIONS

European Patent Application No. 14020010.6; Extended European Search Report dated May 7, 2015; 7 pages.

(Continued)

*Primary Examiner* — Eileen Morgan

(74) *Attorney, Agent, or Firm* — Baker & Hostetler LLP

(57) ABSTRACT

A polishing method which can remove foreign matters from an entire back surface of a substrate at a high removal rate is provided. The polishing method includes placing a polishing tool in sliding contact with an outer circumferential region of a back surface of a substrate while holding a center-side region of the back surface of the substrate, and placing a polishing tool in sliding contact with the center-side region of the back surface of the substrate while holding a bevel portion of the substrate to polish the back surface in its entirety.

16 Claims, 7 Drawing Sheets

(56) References Cited

U.S. PATENT DOCUMENTS

| | | | | |
|---|---|---|---|---|
| 7,351,131 | B2 * | 4/2008 | Nakamura | B24B 9/065 257/E21.237 |
| 7,367,873 | B2 * | 5/2008 | Ishii | B24B 9/065 451/168 |
| 7,621,799 | B2 * | 11/2009 | Sakairi | H01L 21/02024 451/299 |
| 2001/0014570 | A1 * | 8/2001 | Wenski | B24B 9/065 451/41 |
| 2001/0029150 | A1 | 10/2001 | Kimura et al. | |
| 2002/0016074 | A1 | 2/2002 | Kimura et al. | |
| 2002/0077039 | A1 * | 6/2002 | Wenski | H01L 21/02024 451/41 |
| 2003/0092261 | A1 | 5/2003 | Kondo et al. | |
| 2006/0094343 | A1 * | 5/2006 | Sato | B24B 21/002 451/313 |
| 2008/0026185 | A1 * | 1/2008 | Mizushima | B24B 9/065 428/157 |
| 2009/0142992 | A1 * | 6/2009 | Takahashi | B24B 9/065 451/9 |
| 2009/0247055 | A1 * | 10/2009 | Erk | H01L 21/02019 451/44 |
| 2010/0056027 | A1 | 3/2010 | Zapilko et al. | |
| 2010/0104806 | A1 | 4/2010 | Schwandner | |
| 2010/0327414 | A1 | 12/2010 | Schwandner | |
| 2011/0136411 | A1 * | 6/2011 | Nakanishi | B24B 9/065 451/41 |
| 2011/0237164 | A1 * | 9/2011 | Seki | B24B 9/065 451/44 |
| 2011/0256811 | A1 * | 10/2011 | Nakanishi | B24B 9/065 451/41 |
| 2011/0312247 | A1 | 12/2011 | Nakamori et al. | |
| 2012/0135668 | A1 * | 5/2012 | Nakanishi | B24B 21/002 451/28 |
| 2013/0115861 | A1 * | 5/2013 | Priewasser | H01L 21/304 451/54 |
| 2013/0213437 | A1 | 8/2013 | Ishii et al. | |
| 2014/0187126 | A1 * | 7/2014 | Nakanishi | H01L 21/02057 451/44 |
| 2015/0235858 | A1 * | 8/2015 | Lee | H01L 21/02057 438/5 |

FOREIGN PATENT DOCUMENTS

| | | | |
|---|---|---|---|
| JP | 2001-345298 | A | 12/2001 |
| JP | 2005-305586 | A | 11/2005 |
| JP | 2008-042220 | A | 2/2008 |
| JP | 2010-130022 | A | 6/2010 |

OTHER PUBLICATIONS

European Patent Application No. 16181386.0; Extended Search Report; dated Dec. 15, 2016; 8 pages.

* cited by examiner

METHOD OF POLISHING BACK SURFACE OF SUBSTRATE AND SUBSTRATE PROCESSING APPARATUS

CROSS REFERENCE TO RELATED APPLICATION

This application claims priority to Japanese Patent Application No. 2013-18476 filed Feb. 1, 2013, the entire contents of which are hereby incorporated by reference.

BACKGROUND OF THE INVENTION

Field of the Invention

The present invention relates to a method of polishing a back surface of a substrate, such as a wafer. The present invention also relates to a substrate processing apparatus for polishing the back surface of the substrate.

Description of the Related Art

In recent years, various types of devices, such as memory circuits, logic circuits, and image sensors (e.g., complimentary metal-oxide-semiconductor (CMOS) sensors), become more highly integrated. In processes of fabricating these devices, foreign matters, such as fine particles and dust, may be attached to the devices. The foreign matters attached to the devices may cause a defect, such as a short circuit between interconnects or a malfunction of a circuit. Therefore, in order to increase a reliability of the devices, it is necessary to clean a wafer on which the devices are formed so as to remove the foreign matters from the wafer.

The aforementioned foreign matters, such as fine particles and dust, may also be attached to a back surface of the wafer (i.e., a bare silicon surface). If such foreign matters are attached to the back surface of the wafer, the wafer may be separated from a stage reference surface of an exposure apparatus, or a front surface of the wafer may be inclined with respect to the stage reference surface, resulting in a patterning shift or a focal length error. In order to prevent such problems, it is necessary to remove the foreign matters from the back surface of the wafer.

It has been a conventional technique to scrub the wafer with a pen-type brush or a roll sponge while rotating the wafer. However, in such a conventional cleaning technique, a removal rate of the foreign matters is low. In particular, it is difficult to remove the foreign matters on which a film is deposited. Furthermore, it is difficult for the conventional cleaning technique to remove the foreign matters from the entire back surface of the wafer.

SUMMARY OF THE INVENTION

The present invention has been made in view of the above issues. It is therefore an object of the present invention to provide a method and an apparatus which can remove foreign matters from an entire back surface of a substrate, such as a wafer, at a high removal rate.

In an embodiment, a polishing method includes: placing a polishing tool in sliding contact with an outer circumferential region of a back surface of a substrate while holding a center-side region of the back surface of the substrate; and placing a polishing tool in sliding contact with the center-side region of the back surface of the substrate while holding a bevel portion of the substrate to polish the back surface in its entirety.

The placing the polishing tool in sliding contact with the outer circumferential region may be performed prior to the placing the polishing tool in sliding contact with the center-side region.

The placing the polishing tool in sliding contact with the outer circumferential region may comprise placing a polishing tool in sliding contact with an outer circumferential region of a back surface of a substrate while holding a center-side region of the back surface of the substrate and supplying pure water onto the back surface of the substrate; and the placing the polishing tool in sliding contact with the center-side region may comprise placing a polishing tool in sliding contact with the center-side region of the back surface of the substrate while holding a bevel portion of the substrate and supplying pure water onto the back surface of the substrate to polish the back surface in its entirety.

In another embodiment, a substrate processing apparatus includes: a first back-surface polishing unit configured to place a polishing tool in sliding contact with an outer circumferential region of a back surface of a substrate while holding a center-side region of the back surface of the substrate to polish the outer circumferential region; a second back-surface polishing unit configured to place a polishing tool in sliding contact with the center-side region while holding a bevel portion of the substrate to polish the center-side region; and a transfer robot configured to transport the substrate between the first back-surface polishing unit and the second back-surface polishing unit.

The first back-surface polishing unit may be configured to polish the outer circumferential region before the second back-surface polishing unit polishes the center-side region.

The transfer robot may be configured to invert the substrate that has been polished by the first back-surface polishing unit and transport the inverted substrate to the second back-surface polishing unit.

According to the above embodiments, the polishing tool is placed in sliding contact with the back surface of the substrate to thereby scrape away the back surface slightly. Therefore, the foreign matters can be removed from the back surface at a high removal rate. In particular, the foreign matters can be removed from the entire back surface of the substrate by placing the polishing tool in sliding contact with the back surface in its entirety.

DETAILED DESCRIPTION OF AN EMBODIMENT

An embodiment will be described below with reference to the drawings. A polishing method according to an embodiment is constituted by a first polishing process and a second polishing process. The first polishing process is a process of polishing an outer circumferential region of a back surface of a substrate, and the second polishing process is a process of polishing a center-side region of the back surface of the substrate. The center-side region is a region including a center of the substrate, and the outer circumferential region is a region lying radially outwardly of the center-side region. The center-side region adjoins the outer circumferential region, and a combination of the center-side region and the outer circumferential region covers the back surface of the substrate in its entirety. More specifically, an outermost part of the center-side region and an innermost part of the outer circumferential region are connected to each other to cover the back surface in its entirety.

Figure 1A:
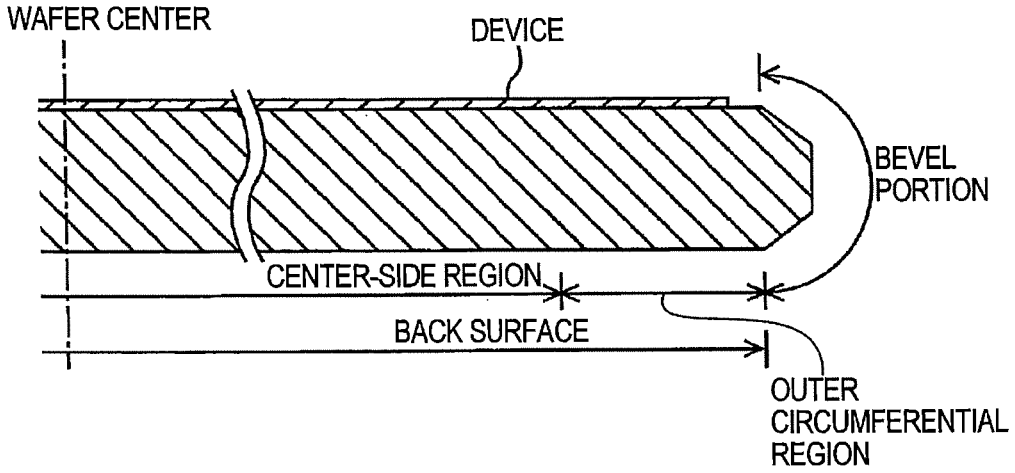
FIG. 1A is an enlarged cross-sectional view of a peripheral portion of a wafer.
Figure 1B:
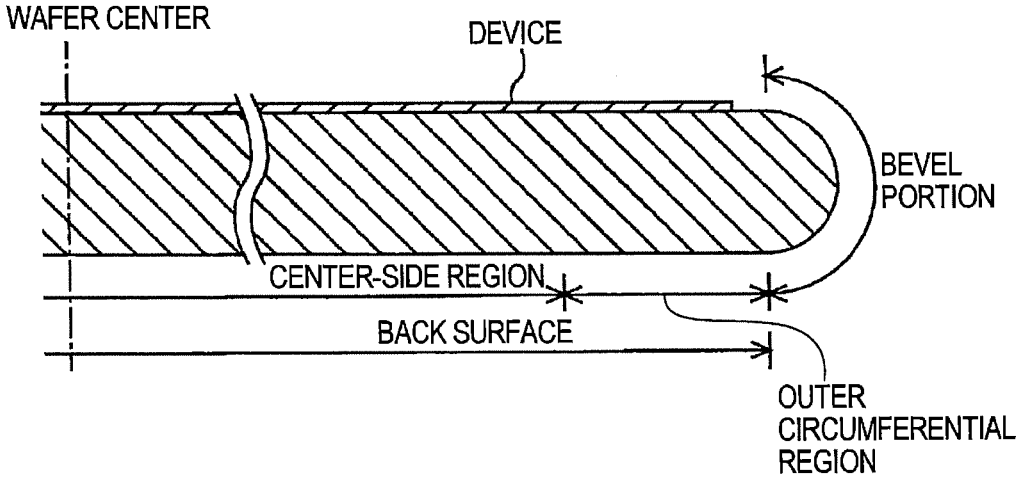
FIG. 1B is an enlarged cross-sectional view of a peripheral portion of a wafer.

FIG. 1A and FIG. 1B are enlarged cross sectional views each showing a peripheral portion of a wafer which is an example of the substrate. More specifically, FIG. 1A is a cross-sectional view of a so-called straight type wafer, and FIG. 1B is a cross-sectional view of a so-called round type wafer. In this specification, the back surface of the wafer (i.e., the substrate) is a flat surface on the opposite side of a surface on which devices are formed. A peripheral round surface of the wafer is called a bevel portion. The back surface of the wafer is the flat surface which is located radially inwardly of the bevel portion. The outer circumferential region of the back surface of the wafer adjoins the bevel portion. In an example, the outer circumferential region is an annular region having a width of ten-odd millimeters, and the center-side region is a circular region lying inside the outer circumferential region.

Figure 2:
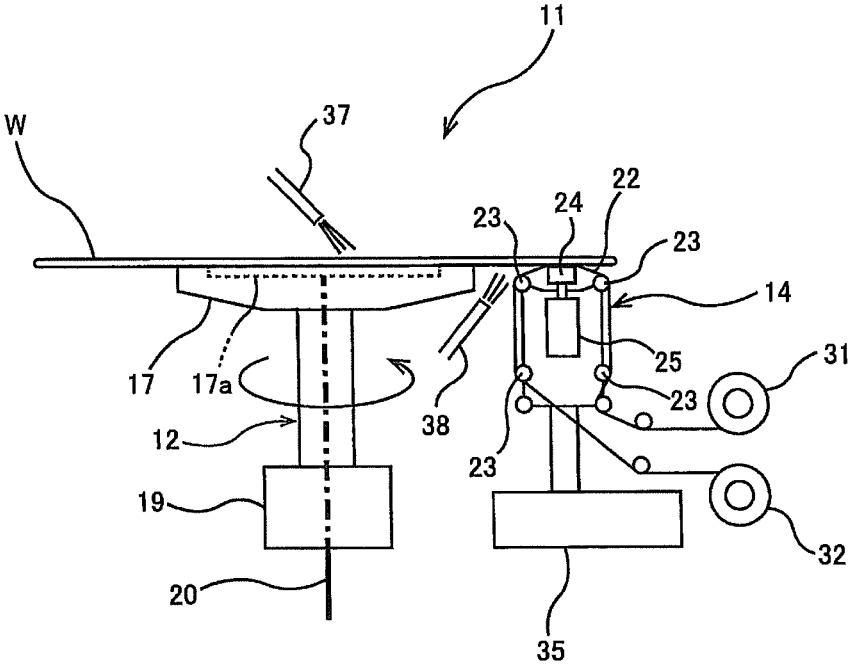
FIG. 2 is a schematic view showing a first back-surface polishing unit for polishing an outer circumferential region of a back surface of the wafer.

FIG. 2 is a schematic view showing a first back-surface polishing unit 11 for polishing the outer circumferential region of the back surface of the wafer W. This first back-surface polishing unit 11 has a first substrate holder 12 for holding and rotating the wafer (i.e., substrate) W, and a first polishing head 14 for pressing a polishing tool against the back surface of the wafer W when held by the first substrate holder 12. The first substrate holder 12 has a substrate stage 17 configured to hold the wafer W by vacuum suction, and a motor 19 configured to rotate the substrate stage 17.

The wafer W is placed on the substrate stage 17 with the back surface of the wafer W facing downward. A groove 17*a* is formed on a top surface of the substrate stage 17, and this groove 17*a* communicates with a vacuum line 20. The vacuum line 20 is coupled to a vacuum source (e.g., a vacuum pump) which is not shown in the figures. When a vacuum is created in the groove 17*a* of the substrate stage 17 through the vacuum line 20, the wafer W is held on the substrate stage 17 by a vacuum suction force. In this state, the motor 19 rotates the substrate stage 17 to thereby rotate the wafer W around its axis. The substrate stage 17 is smaller than a diameter of the wafer W, and the center-side region of the back surface of the wafer W is held by the substrate stage 17. The outer circumferential region of the back surface of the wafer W protrudes outwardly from the substrate stage 17.

The first polishing head 14 is arranged adjacent to the substrate stage 17. More specifically, the first polishing head 14 is located so as to face the exposed outer circumferential region of the back surface of the wafer W. The first polishing head 14 has a plurality of rollers 23 which support a polishing tape 22 serving as the polishing tool, a pressing member 24 for pressing the polishing tape 22 against the back surface of the wafer W, and a pneumatic cylinder 25 as an actuator for applying a pressing force to the pressing member 24. The pneumatic cylinder 25 applies the pressing force to the pressing member 24, so that the pressing member 24 presses the polishing tape 22 against the back surface of the wafer W. Instead of the polishing tape, a grindstone may be used as the polishing tool.

One end of the polishing tape 22 is connected to a feeding reel 31, and the other end is connected to a take-up reel 32. The polishing tape 22 is advanced at a predetermined speed from the feeding reel 31 to the take-up reel 32 via the first polishing head 14. Examples of the polishing tape 22 to be used include a tape having abrasive grains fixed to a surface thereof, and a tape constituted by a hard nonwoven fabric. The first polishing head 14 is coupled to a polishing head moving mechanism 35. This polishing head moving mechanism 35 is configured to move the first polishing head 14 outwardly in the radial direction of the wafer W. The polishing head moving mechanism 35 may be constructed by a combination of a ball screw and a servomotor.

Liquid supply nozzles 37, 38 for supplying a polishing liquid onto the wafer W are arranged above and below the wafer W which is held by the substrate stage 17. Pure water may be used as the polishing liquid. This is for the reason that use of a polishing liquid containing a chemical component having an etching action may enlarge a recess formed on the back surface of the wafer W.

Figure 3:
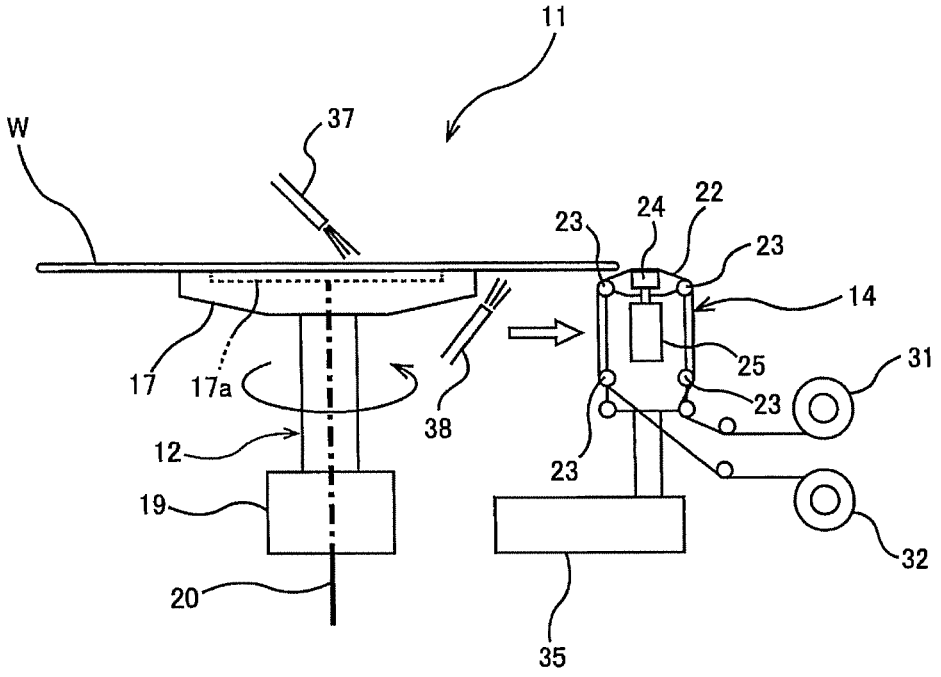
FIG. 3 is a view of a polishing head that has been moved outwardly in a radial direction of the wafer.

The outer circumferential region of the back surface of the wafer W is polished as follows. The wafer W, which is held on the substrate stage 17, is rotated about its axis by the motor 19, and the polishing liquid is supplied from the liquid supply nozzles 37, 38 to a front surface and the back surface of the rotating wafer W. In this state, the first polishing head 14 presses the polishing tape 22 against the back surface of the wafer W. The polishing tape 22 is placed in sliding contact with the outer circumferential region to thereby polish the outer circumferential region. The polishing head moving mechanism 35 moves the first polishing head 14 outwardly in the radial direction of the wafer W at a predetermined speed as indicated by arrow shown in FIG. 3, while the first polishing head 14 is pressing the polishing tape 22 against the back surface of the wafer W. In this manner, the outer circumferential region in its entirety is polished by the polishing tape 22. During polishing, the polishing liquid flows from the inside to the outside of the wafer W to thereby remove polishing debris from the wafer W.

After the first polishing process is terminated, the wafer W is removed from the first back-surface polishing unit 11 by a transfer robot which is not shown in the figures. The transfer robot inverts the wafer W so that the back surface of the wafer W faces upward, and transports the inverted wafer W to a second back-surface polishing unit which will be explained below.

Figure 4:
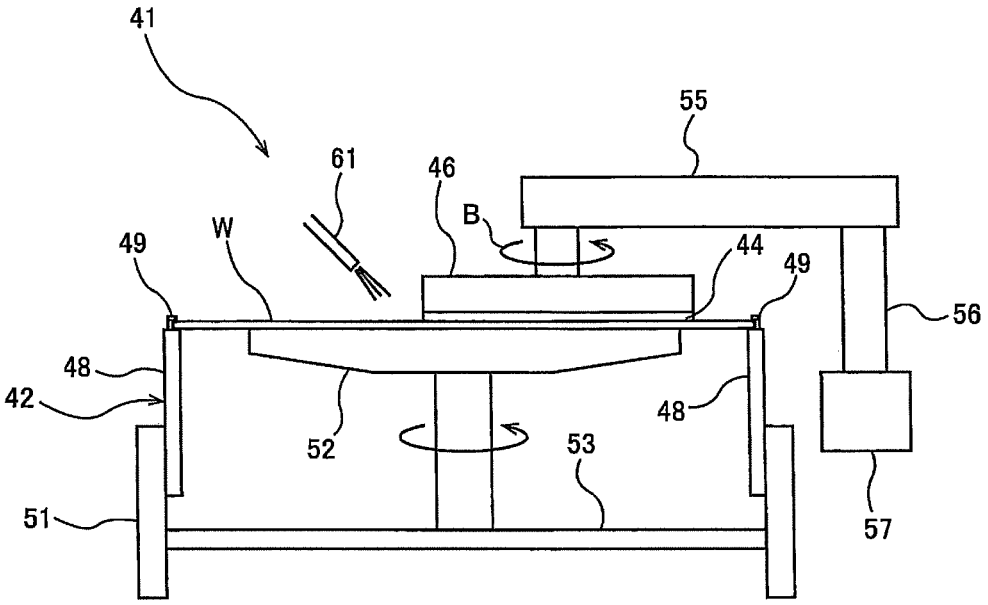
FIG. 4 is a schematic view showing a second back-surface polishing unit for polishing a center-side region of the back surface of the wafer.
Figure 5:
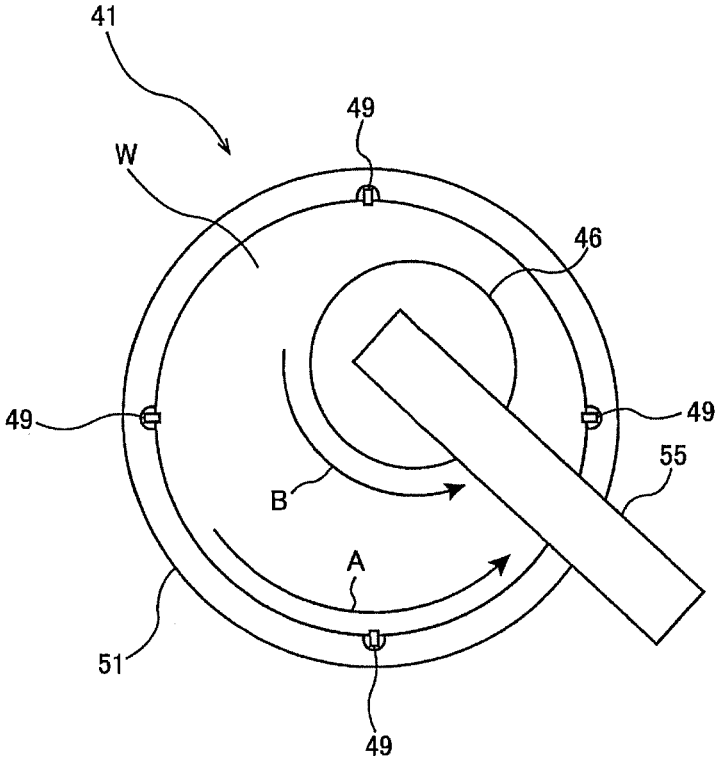
FIG. 5 is a plan view of the second back-surface polishing unit.

FIG. 4 is a schematic view showing the second back-surface polishing unit for polishing the center-side region of the back surface of the wafer W, and FIG. 5 is a plan view of the second back-surface polishing unit. The second back-surface polishing unit 41 has a second substrate holder 42 configured to hold and rotate the wafer W, and a second polishing head 46 configured to press a polishing tool 44 against the back surface of the wafer W. The second substrate holder 42 has a plurality of chucks 48 for holding a bevel portion of the wafer W, and further has a hollow motor 51 for rotating these chucks 48 around the axis of the wafer W. Each chuck 48 has a clamp 49 at its upper end, and the bevel portion of the wafer W is gripped by this clamp 49. With the clamps 49 gripping the bevel portion of the wafer W, the hollow motor 51 rotates the chucks 48 to thereby rotate the wafer W around its axis as indicated by arrow A shown in FIG. 5.

In the second back-surface polishing unit 41, the wafer W is held by the second substrate holder 42 with the back surface of the wafer W facing upward. The lower surface (i.e., the surface opposite to the back surface) of the wafer W, which is held by the chucks 48, is supported by a substrate supporting member 52. This substrate supporting member 52 is coupled to the hollow motor 51 through a connection member 53 so that the substrate supporting member 52 is rotated together with the second substrate holder 42 by the hollow motor 51. The substrate supporting member 52 has a circular upper surface which contacts the lower surface of the wafer W. This upper surface of the substrate supporting member 52 is constituted by a sheet which is made of an elastic material, such as a nonwoven fabric or a backing film, so as not to cause damage to devices fabricated on the wafer W. The substrate supporting member 52 merely supports the lower surface of the wafer W and does not hold the wafer W by the vacuum suction or the like. The wafer W and the substrate supporting member 52 are rotated in synchronization with each other, and a relative speed between the wafer W and the substrate supporting member 52 is 0.

The second polishing head 46 is arranged above the wafer W and is configured to press the polishing tool 44 downwardly against the back surface of the wafer W. Examples of the polishing tool 44 to be used include a nonwoven fabric having abrasive grains fixed to a surface thereof, a hard nonwoven fabric, a grindstone, and the polishing tape which is used in the aforementioned first back-surface polishing unit 11. For example, the polishing tool 44 may be a plurality of polishing tapes which are arranged around an axis of the second polishing head 46.

The second polishing head 46 is supported by a head arm 55. A rotating mechanism, which is not shown in the figures, is provided in this head arm 55 so that the second polishing head 46 is rotated around its axis by the rotating mechanism as indicated by arrow B. An end of the head arm 55 is fixed to a pivot shaft 56. This pivot shaft 56 is coupled to an actuator 57, such as a motor. This actuator 57 rotates the pivot shaft 56 through a predetermined angle to thereby move the second polishing head 46 between a polishing position which is above the wafer W and a standby position which is outside of wafer W.

A liquid supply nozzle 61 for supplying a polishing liquid to the back surface of the wafer W is disposed adjacent to the second polishing head 46. Pure water may be used as the polishing liquid.

The center-side region of the back surface of the wafer W is polished as follows. With the back surface of the wafer W facing upward, the bevel portion of the wafer W is held by the chucks 48. The wafer W is rotated around the axis thereof by the hollow motor 51, and the polishing liquid is supplied from the liquid supply nozzle 61 onto the back surface of the rotating wafer W. In this state, the second polishing head 46 presses the polishing tool 44 against the center-side region which includes the center of the back surface of the wafer W, while rotating the polishing tool 44. The polishing tool 44 is placed in sliding contact with the center-side region of the back surface of the wafer W to thereby polish the center-side region. During polishing, the second polishing head 46 may oscillate in the radial direction of the wafer W while keeping the polishing tool 44 in contact with the center of the wafer W. In this manner, the center-side region of the back surface of the wafer W is polished by the polishing tool 44. During polishing, the polishing liquid flows from the inside to the outside of the wafer W to thereby remove polishing debris from the wafer W.

In the above-discussed embodiment, the outer circumferential region of the back surface of the wafer W is firstly polished, and subsequently the center-side region of the back surface is polished. This is for the reason that a suction mark of the substrate stage 17, which could be left on the back surface of the wafer W in the first polishing process, is cleared in the second polishing process. However, the present invention is not limited to this embodiment. The center-side region of the back surface may be firstly polished, and then the outer circumferential region may be polished.

Because the center-side region of the back surface of the wafer W is held in the first polishing process, it is not possible to polish the center of the wafer W with the polishing tape 22, but it is possible to polish the outer circumferential region of the back surface. On the other hand, because the bevel portion of the wafer W is held by the second substrate holder 42 in the second polishing process, it is not possible to polish the outer circumferential region of the back surface of the wafer W with the polishing tool 44, but it is possible to polish the center-side region which includes the center of the back surface of the wafer W. Therefore, the combination of the first polishing process and the second polishing process can polish the back surface of the wafer W in its entirety. As a result, the foreign matters and projections can be removed from the entire back surface of the wafer W. In the second polishing process, the polishing tool 44 may be placed in sliding contact with the center-side region and the innermost part of the outer circumferential region of the back surface of the substrate.

In the first polishing process and the second polishing process, the back surface of the wafer W is slightly scraped away by the polishing tools 22, 44. An amount of the wafer W removed by the polishing tools 22, 44 (which corresponds to a removed thickness) may be not more than 100 nm, preferably not more than 10 nm, and more preferably not more than 1 nm. A polishing endpoint is determined based on a time. Specifically, the polishing of the wafer W is terminated when a predetermined polishing time is reached. After the second polishing process is terminated, the wafer W may be transported to a cleaning apparatus where both surfaces of the wafer W may be cleaned.

Figure 6:
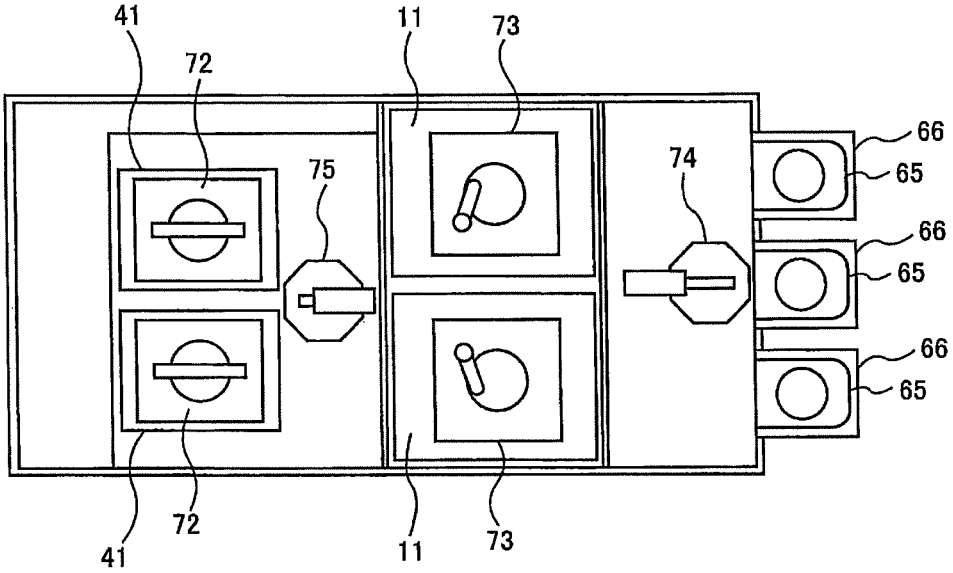
FIG. 6 is a plan view showing a substrate processing apparatus provided with a plurality of substrate processing units including the first back-surface polishing unit and the second back-surface polishing unit.
Figure 7:
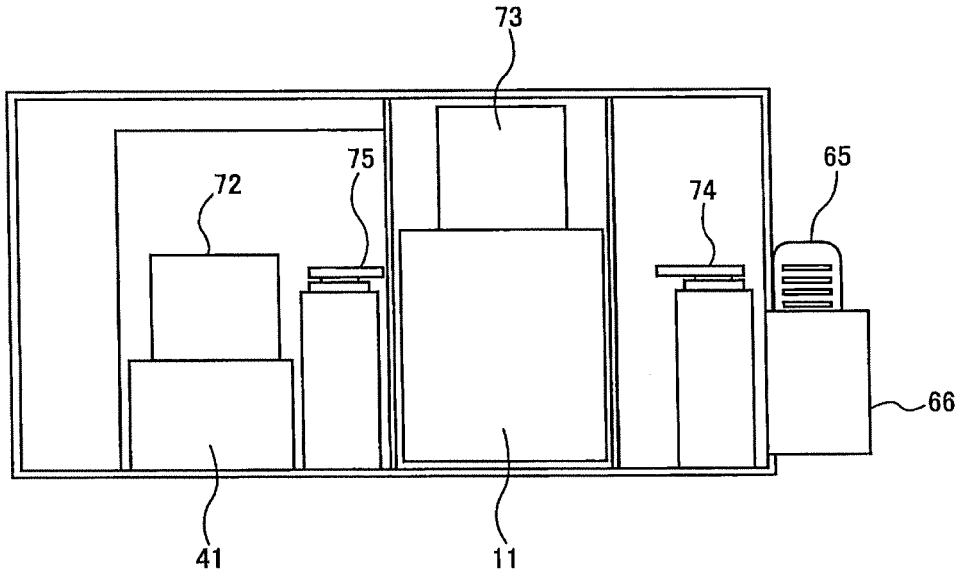
FIG. 7 is a side view of the substrate processing apparatus shown in FIG. 6.

FIG. 6 is a plan view showing a substrate processing apparatus provided with a plurality of substrate processing units including the first back-surface polishing unit 11 and the second back-surface polishing unit 41. FIG. 7 is a side view of the substrate processing apparatus shown in FIG. 6. This substrate processing apparatus has load ports 66 on which wafer cassettes 65, each storing a plurality of wafers W, are placed, two first back-surface polishing units 11, two second back-surface polishing units 41, two cleaning units 72 each for cleaning the polished wafer W, and two drying units 73 each for drying the cleaned wafer W.

The two cleaning units 72 are disposed on the two second back-surface polishing units 41, respectively. The two drying units 73 are disposed on the two first back-surface polishing units 11, respectively. A first transfer robot 74 is provided between the load ports 66 and the first back-surface polishing units 11. Further, a second transfer robot 75 is provided between the first back-surface polishing units 11 and the second back-surface polishing units 41.

The wafer W in the wafer cassette 65 is transported to the first back-surface polishing unit 11 by the first transfer robot 74, and the outer circumferential region of the back surface of the wafer W is polished in the first back-surface polishing unit 11. The first polishing head 14 of the first back-surface polishing unit 11 may be provided with a tilting mechanism so that the first polishing head 14 can further polish the bevel portion of the wafer W. The wafer W is removed from the first back-surface polishing unit 11 by the second transfer robot 75, and is inverted such that the back surface of the wafer W faces upward. The inverted wafer W is then transported to the second back-surface polishing unit 41, where the center-side region of the back surface of the wafer W is polished. Before being transported to the second back-surface polishing unit 41, the wafer W, whose outer circumferential region of the back surface has been polished, may be transported to the cleaning unit 72 so that the wafer W is cleaned.

The wafer W, whose back surface in its entirety has been polished, is removed from the second back-surface polishing unit 41 by the second transfer robot 75, and is inverted such that the back surface of the wafer W faces downward. In this state, the wafer W is transported to the cleaning unit 72. This cleaning unit 72 has an upper roll sponge and a lower roll sponge which are arranged so as to sandwich the wafer W therebetween. The cleaning unit 72 scrubs both surfaces of the wafer W with these roll sponges while supplying a cleaning liquid onto both surfaces of the wafer W. The cleaned wafer W is transported to the drying unit 73 by the second transfer robot 75. The drying unit 73 rotates the wafer W at a high speed around the axis of the wafer W to thereby spin-dry the wafer W. The dried wafer W is returned to the wafer cassette 65 on the load port 66 by the first transfer robot 74. In this manner, the substrate processing apparatus performs a series of processes including polishing of the back surface of the wafer W, cleaning of the wafer W, and drying of the wafer W.

The first back-surface polishing unit 11, the second back-surface polishing unit 41, the cleaning unit 72, and the drying unit 73 are constructed as modularized units, respectively, and an arrangement of these units can be changed freely. For example, instead of either or both of the two first back-surface polishing units 11 shown in FIG. 6, a notch polishing unit for polishing a notch portion of the wafer W may be provided.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A polishing method of polishing an entirety of a back surface of a substrate, comprising:

first polishing an outer circumferential region of the back surface of the substrate by placing a first polishing tool in sliding contact with the outer circumferential region of the back surface of the substrate, while holding a center-side region of the back surface of the substrate;

second polishing the center-side region of the back surface of the substrate by placing a second polishing tool in sliding contact with the center-side region of the back surface of the substrate, while holding the substrate, supporting a front side of the substrate, and rotating the second polishing tool around an axis of a rotational shaft which extends in a direction perpendicular to the back surface of the substrate; and inverting the substrate, said inverting being performed between said first polishing and said second polishing, wherein the first polishing tool is placed in sliding contact with only the back surface of the substrate during the first polishing.

2. The polishing method according to claim 1, wherein said first polishing is performed prior to said second polishing.

3. The polishing method according to claim 1, wherein:

said first polishing comprises placing the first polishing tool in sliding contact with the outer circumferential region of the back surface of the substrate while holding the center-side region of the back surface of the substrate and supplying pure water onto the back surface of the substrate; and said second polishing comprises placing the second polishing tool in sliding contact with the center-side region of the back surface of the substrate while holding a bevel portion of the substrate and supplying pure water onto the back surface of the substrate.

4. The polishing method according to claim 1, wherein an outermost part of the center-side region and an innermost part of the outer circumferential region are connected to each other to cover the entirety of the back surface.

5. The polishing method according to claim 1, wherein said second polishing comprises placing the second polishing tool in sliding contact with the center-side region and an innermost part of the outer circumferential region of the back surface of the substrate while holding a bevel portion of the substrate.

6. The polishing method according to claim 2, further comprising:

inverting the substrate after said first polishing and before said second polishing.

7. The polishing method according to claim 2, further comprising:

transporting the substrate after said first polishing and before said second polishing; and inverting the substrate during said transporting the substrate.

8. The polishing method according to claim 2, wherein an outermost part of the center-side region and an innermost part of the outer circumferential region are connected to each other to cover the entirety of the back surface.

9. The polishing method according to claim 2, wherein said second polishing comprises placing the second polishing tool in sliding contact with the center-side region and an innermost part of the outer circumferential region of the back surface of the substrate while holding a bevel portion of the substrate.

10. The polishing method according to claim 1, wherein said first polishing comprises pressing the first polishing tool against the outer circumferential region of the back surface of the substrate with a pressing member, and moving the first polishing tool and the pressing member together in a radial direction of the substrate, while holding the center-side region of the back surface of the substrate.

11. A polishing method of polishing an entirety of a back surface of a substrate, comprising:

first polishing an outer circumferential region of the back surface of the substrate by placing a first polishing tool in sliding contact with the outer circumferential region of the back surface of the substrate, while holding a center-side region of the back surface of the substrate;

second polishing the center-side region of the back surface of the substrate by placing a second polishing tool in sliding contact with the center-side region of the back surface of the substrate, while holding the substrate, supporting a front side of the substrate, and rotating the second polishing tool around an axis of a rotational shaft which extends in a direction perpendicular to the back surface of the substrate; and inverting the substrate, said inverting being performed between said first polishing and said second polishing, wherein the second polishing tool oscillates in a radial direction of the substrate during the second polishing.

12. A polishing method of polishing an entirety of a back surface of a substrate, comprising:

first polishing an outer circumferential region of the back surface of the substrate by placing a first polishing tool in sliding contact with the outer circumferential region of the back surface of the substrate, while holding a center-side region of the back surface of the substrate;

second polishing the center-side region of the back surface of the substrate by placing a second polishing tool in sliding contact with the center-side region of the back surface of the substrate, while holding the substrate and supporting a front side of the substrate; and inverting the substrate, said inverting being performed between said first polishing and said second polishing.

13. The polishing method according to claim 12, wherein the second polishing tool comprises a plurality of a polishing tape.

14. The polishing method according to claim 12, wherein said first polishing is performed prior to said second polishing.

15. The polishing method according to claim 12, further comprising:

rotating the substrate during said first polishing.

16. The polishing method according to claim 12, wherein said first polishing and said second polishing are performed before an exposure process.

* * * * *